US005655697A

United States Patent [19]

Yeh

[11] Patent Number: 5,655,697

[45] Date of Patent: Aug. 12, 1997

[54] MINITYPE PERFORATOR/STAPLER

[76] Inventor: Morgen Yeh, 2nd Floor, No. 20, Lane 276, Chung Cheng North Road, San Chung City, Taipei Hsien, Taiwan

[21] Appl. No.: 657,440

[22] Filed: Jun. 3, 1996

[51] Int. Cl.[6] ..... B25C 5/02; B26F 1/02

[52] U.S. Cl. ..... 227/27; 227/76; 227/120

[58] Field of Search ..... 227/27, 76, 120, 227/132, 134

[56] References Cited

U.S. PATENT DOCUMENTS

| | | | |
|---|---|---|---|
| 2,922,163 | 1/1960 | Smick | 227/134 X |
| 4,114,793 | 9/1978 | Hsu | 227/76 X |
| 4,288,018 | 9/1981 | Taniguchi | 227/76 |
| 4,491,261 | 1/1985 | Mitsuhashi | 227/76 |
| 4,569,469 | 2/1986 | Mongeon et al. | 227/120 X |
| 4,640,451 | 2/1987 | Steiner et al. | 227/76 |
| 4,727,610 | 3/1988 | Lin | 227/76 X |
| 4,795,073 | 1/1989 | Yamamoto et al. | 227/120 |
| 5,184,765 | 2/1993 | Orozco | 227/27 |

*Primary Examiner*—Joseph J. Hail, III
*Assistant Examiner*—Jay A. Stelacone
*Attorney, Agent, or Firm*—Morton J. Rosenberg; David I. Klein

[57] ABSTRACT

A minitype perforator/stapler including a main body, a perforating device is provided and a stapling device. The perforating device has a depression portion resiliently slidably disposed in a first side of the main body that is biased by a spring. A perforating knife is connected under a lower end of the depression portion. By depressing the depression portion, the perforating knife is able to perforate papers placed thereunder. The stapling device has a depression portion and a staple magazine. The depression portion is connected with a pressing board and resiliently slidably disposed in a second side of the main body. The staple magazine is stored in a channel formed in the main body at normal time. When used, the magazine is inserted into a magazine socket of the main body under the pressing board. By means of depressing the depression portion, the pressing board is able to extend into the magazine and press out the staple contained therein for stapling the papers placed thereunder.

3 Claims, 5 Drawing Sheets

MINITYPE PERFORATOR/STAPLER

BACKGROUND OF THE INVENTION

The present invention relates to a minitype perforator/stapler in which a perforating device and a stapling device are combined into a thin flat unit which has a small volume and can be easily carried and freely used to perforate and staple papers.

A conventional perforator or stapler is manufactured as separate units, with considerably large volume. When a user needs to use such a perforator and a stapler at a remote location, the user must carry both the perforator and stapler separately. This is quite inconvenient to the user. Moreover, the perforator and the stapler have different irregular shapes and cannot be tidily carried and received in a suitcase. furthermore, the perforator and the stapler are independently manufactured so that when it is necessary to continuously perform perforation and stapling operations, the user must repeatedly work with the perforator and the stapler in turn.

SUMMARY OF THE INVENTION

It is therefore a primary object of the present invention to provide a minitype perforator/stapler including a perforating device and a stapling device combined into a thin flat unit which has small volume and can be easily carried and freely used portably to perforate and staple papers.

The present invention can be best understood through the following description and accompanying drawings, wherein.

DETAILED DESCRIPTION OF THE PREFERRED EMBODIMENT

Figure 1:
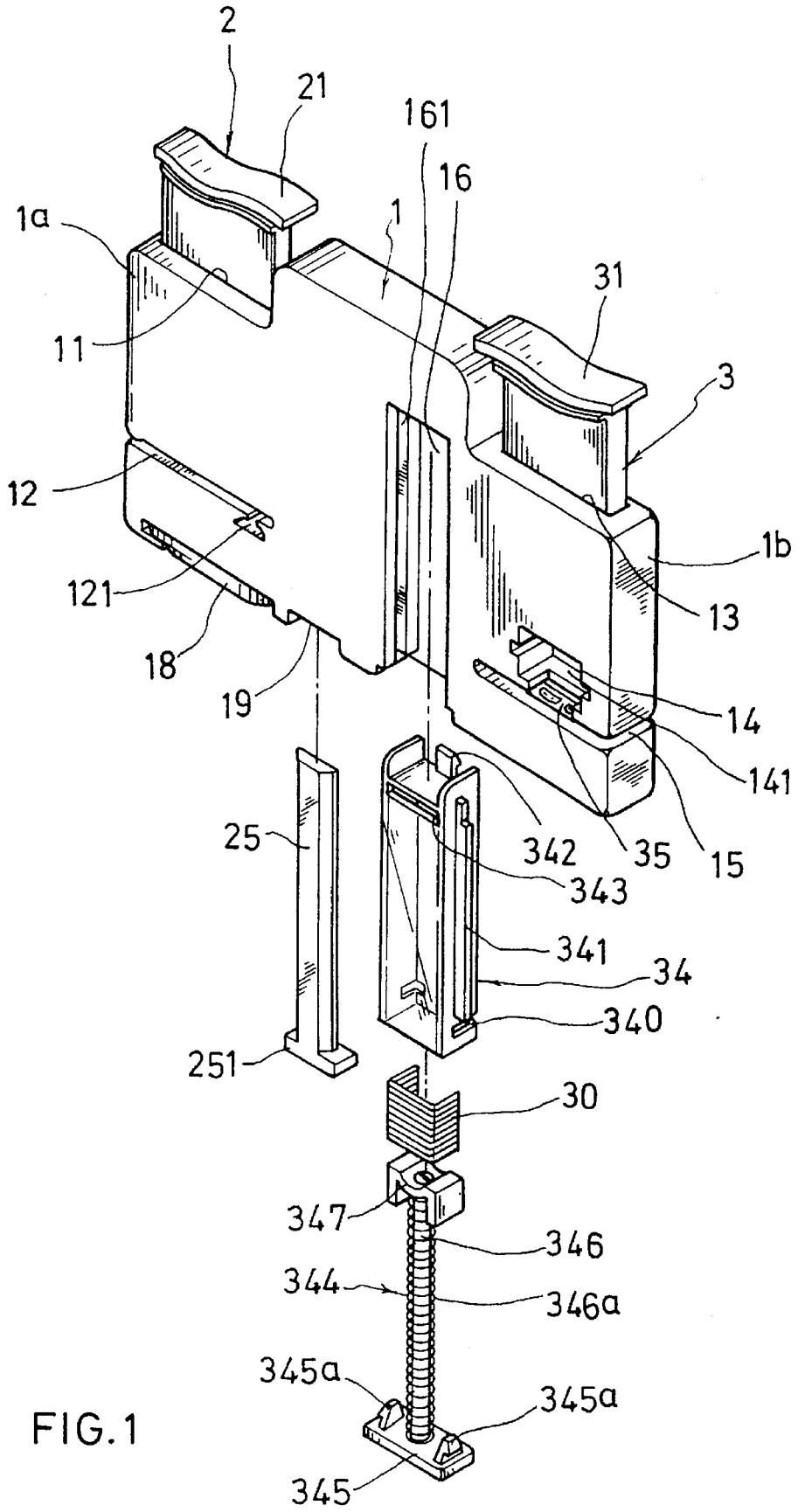
FIG. 1 is a perspective partially exploded view of the present invention.
Figure 4:
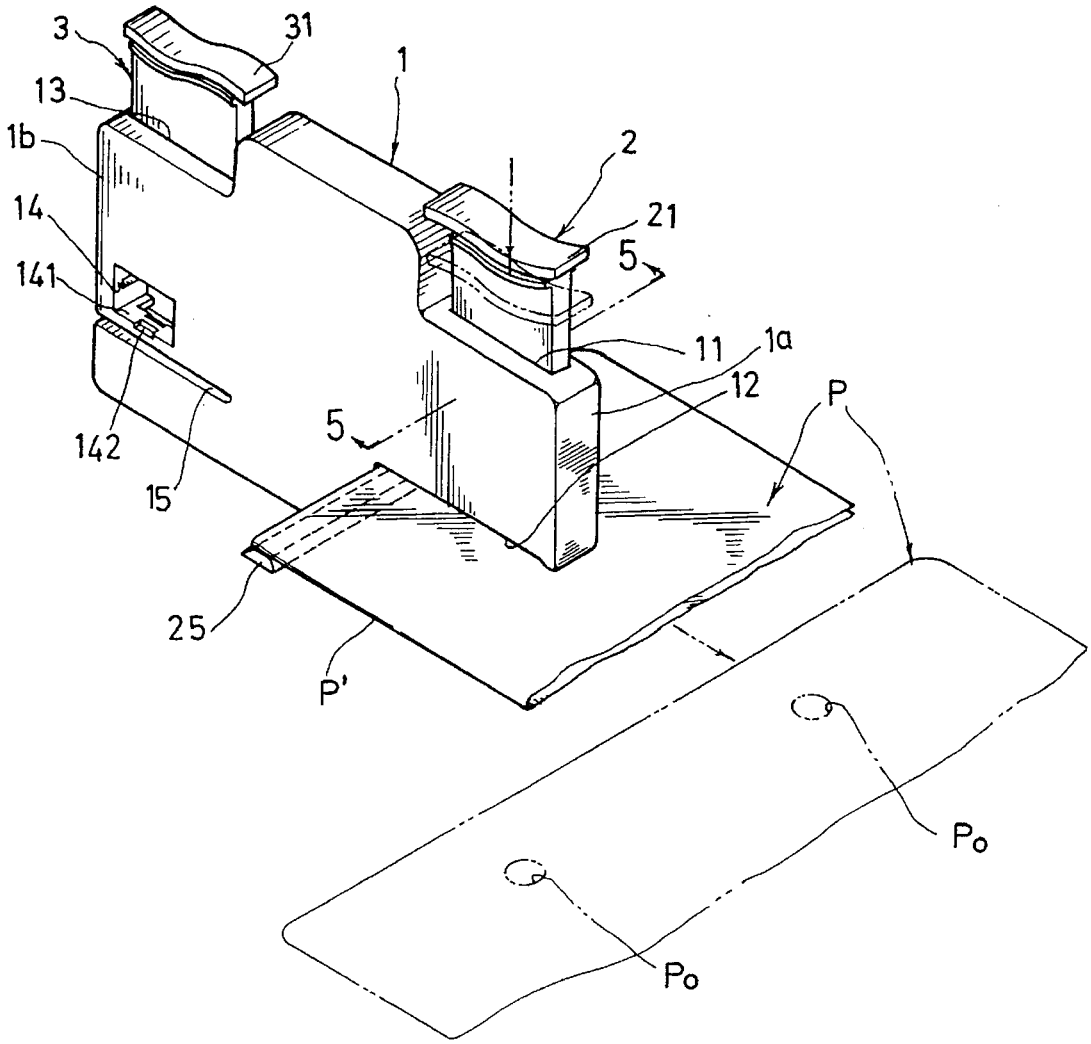
FIG. 4 is a perspective view showing that a gauge scale is used to determine the gauge between the perforated holes.

As shown in FIGS. 1 and 4, the present invention includes a main body 1, a perforating device 2 and a stapling device 3. The perforating device 2 is resiliently slidably disposed in a first side 1a of the main body 1. When depressed, the perforating device 2 is able to perforate papers P positioned thereunder. The stapling device 3 is resiliently slidably disposed in a second side 1*b* of the main body 1. Similarly, when depressed, the stapling device 3 serves to press out a staple 30 loaded in a staple magazine 34 for stapling papers P. The perforating device and the stapling device are combined in the same minitype main body 1 and can be easily carried.

The main body 1 includes a first slide way 11, a second slide way 13, a magazine socket 14, a stapling slot 15 and a magazine locating channel 16. The first slide way 11 is formed in the first side 1*a* of the main body 1, whereby a depression portion 21 of the perforating device 2 is resiliently slidably fitted therein. A perforating slot 12 is horizontally formed on the lateral edge of the first side 1*a* of the main body 1 under the first slide way 11, whereby papers P can be placed in the perforating slot 12 for perforation. The second slide way 13 is formed in the second side 1*b* of the main body 1, whereby a depression portion 31 of the stapling device 3 can be resiliently slidably fitted therein. The magazine socket 14 is formed under the second slide way 13 for engaging a staple magazine 34 therein. The stapling slot 15 is horizontally formed on a lateral edge of the second side 1*b* of the main body 1, whereby papers P can be placed therein for stapling. The magazine locating channel 16 is vertically formed on a middle portion of the main body 1, whereby when not used, the staple magazine 34 can be securely located therein.

The main body 1 can be designed with a card-like thin flat pattern as shown in FIG. 1. However, the main body can be otherwise shaped with different patterns.

Figure 2:
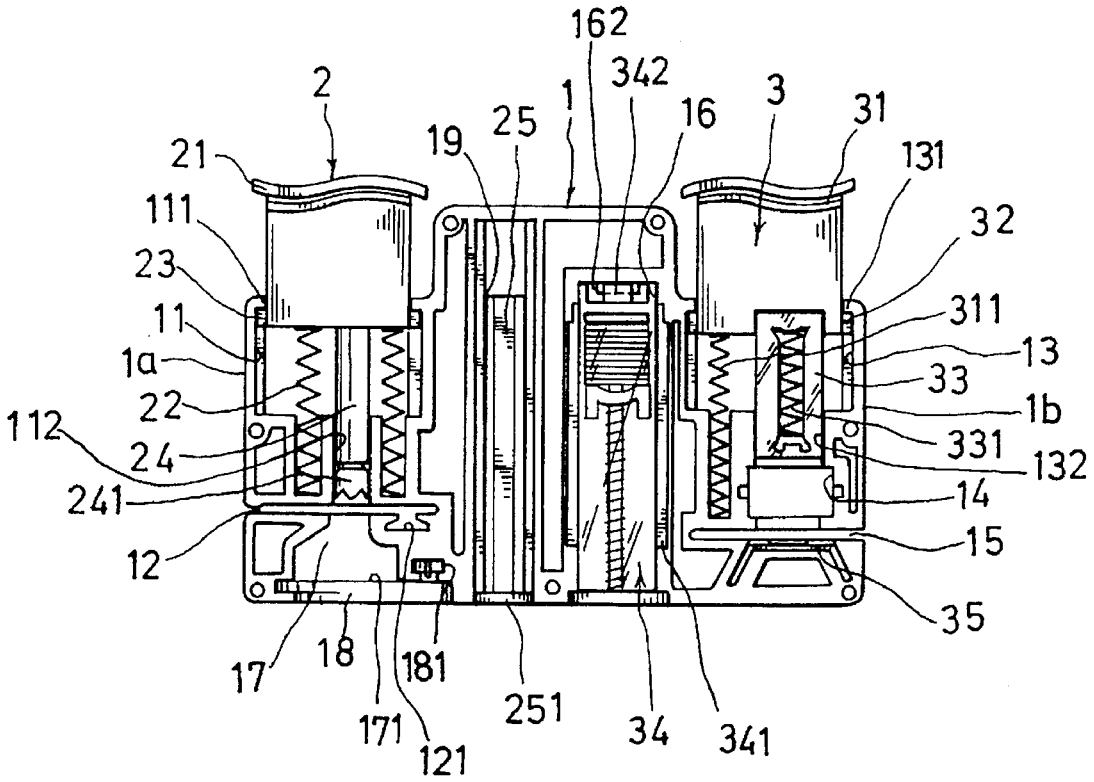
FIG. 2 is a side sectional assembled view of the present invention.
Figure 3:
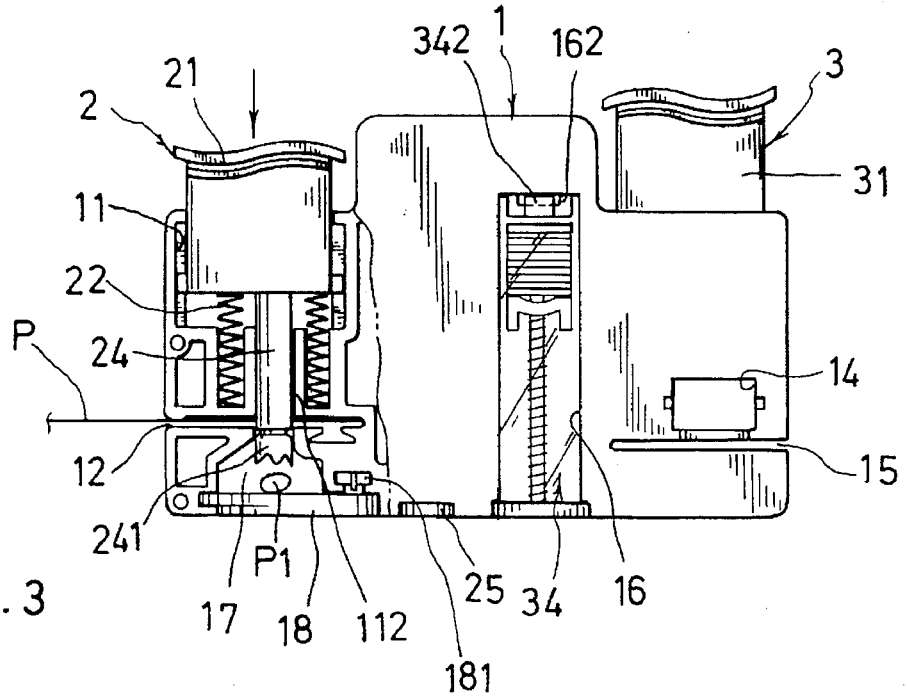
FIG. 3 is a side view according to FIG. 2, showing the depression portion of the perforating device depressed for perforation.

Referring to FIGS. 1 to 3, the perforating device 2 includes a depression portion 21 slidably fitted in the first slide way 11 of the main body 1, at least one spring 22 compressed between a bottom end of the depression portion 21 and a bottom portion of the first slide way 11 to upwardly push the depression portion 21. At least one lug 23 laterally projecting from the bottom end of the depression portion 21 is provided for abutting against an upper stopper edge 111 of the first slide way 11 when the depression portion 21 is pushed upward. A supporting stem 24 is connected under the bottom end of the depression portion 21. A perforating knife 241 is secured to the lower end of the supporting stem 24 and the bottom end of the first slide way 11 is formed with a guide bore 112, whereby when the depression portion 21 is pressed downward, the perforating knife 241 is moved downward to penetrate through the perforating slot 12 of the main body into the guide bore 112 so as to perforate the papers.

In order to receive the paper chips P1 cut by the perforating device 2 after perforation, a chip collecting portion 17 is formed on the bottom of the main body 1 in alignment with the perforating knife 241. In addition, a chip stopping board 18 is pivotally disposed under the bottom of the main body 1 by a pivot shaft 181 to seal a bottom exit 171 of the chip collecting portion 17, whereby the paper chips P1 therein are prevented from scattering outside.

Figure 5:
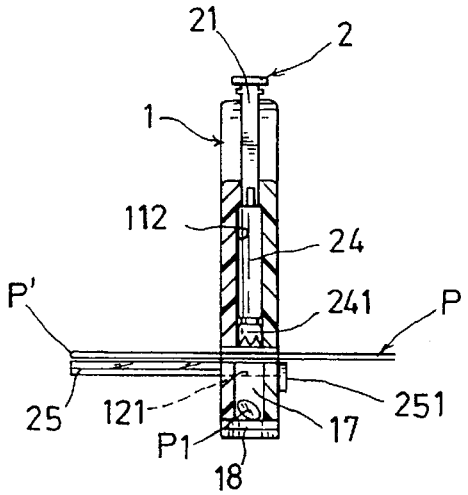
FIG. 5 is a sectional view taken along Line 5—5 of FIG. 4.

Referring additionally to FIGS. 4 and 5, to perforate the papers P with two holes Po, having standard gauge for a file clip to fit therein, the perforating device further includes a hole gauge scale 25 which is normally slidably fitted in a receptacle bore 19 of the main body 1. When it is desired to perforate the papers with two holes Po having standard gauge, the gauge scale 25 is taken out from the receptacle 19 and inserted into a cavity 121 formed below the perforating slot 12. At this time, a stopper plate 251 at one end of the gauge scale 25 abuts against one side of the cavity 121 and the other end of the gauge scale 25 is flush with a folding edge P' of the folded papers P. After the perforating device 2 is depressed to perforate the papers P, the papers P are unfolded to achieve two holes Po having standard hole gauge. The gauge scale 25 can be further marked with scales, not shown, for determining the distance between the perforated holes and the edge of the papers.

The stapling device 3 includes a depression portion 31 slidably fitted in the second slide way 13 of the main body 1, at least one spring 311 compressed between the bottom end of the depression portion 31 and the bottom portion of the second slide way 13 to upwardly push the depression portion 31. At least one stopper block 32 projecting from the bottom end of the depression portion 31 is provided for abutting against an upper stopping edge 131 of the second slide way when the depression portion 31 is pushed upward by the spring 311. A pressing board 33 is connected under the bottom end of the depression portion 31 and slidable in a guide channel 132 of the second guide way 13. A spring 331 is compressed between the pressing board 33 and the guide channel 132, and a staple magazine 34 for loading staples 30 therein. The staple magazine 34 includes a pair of slide rails 341 disposed on two lateral sides thereof and slidably fitted in two slide channels 161 of the magazine locating channel 16 of the main body when not being used. The staple magazine 34 further includes a latch member 342 extending from the magazine 34, whereby when the magazine 34 is fitted in the magazine locating channel 16, the latch member 342 is latched in a latch hole 162 thereof so as to securely locate the magazine 34. A pair of slits 343, 343' are formed on opposite sides of the front end of the magazine 16 in alignment with a first staple of a row of staples 30 contained in the magazine 16. When the depression portion 31 is pressed downward, the pressing board 33 is moved downward to penetrate through the slits 343, 343' so as to press out the first staple from the magazine 34 for stapling the papers P positioned in the stapling slot 15. The stapling device further includes a staple pushing member 344 having an end board 345. The end board 345 is disposed with a pair of lugs 345*a* for engaging with two latch holes 340 of lower end of the magazine 34. A slide rod 346 upwardly extends from the end board 345 and a spring 346*a* is fitted around the slide rod 346. A pushing block 347 is disposed at the upper end of the spring 346*a*, whereby the pushing block 347 pushes the row of staples 30 forward, so as to keep a staple 30 in alignment with the slits 343, 343'.

A metallic board 35 is disposed under the stapling slot 15 in alignment with the pressing board 33, whereby after the staple 30 is pressed by the pressing board 33 to penetrate through the papers, the staple 30 is curved by the metallic board 35 for binding the papers together. In the case that the main body 1 is made of hard enough material, the metallic board 35 can be omitted.

Figure 6:
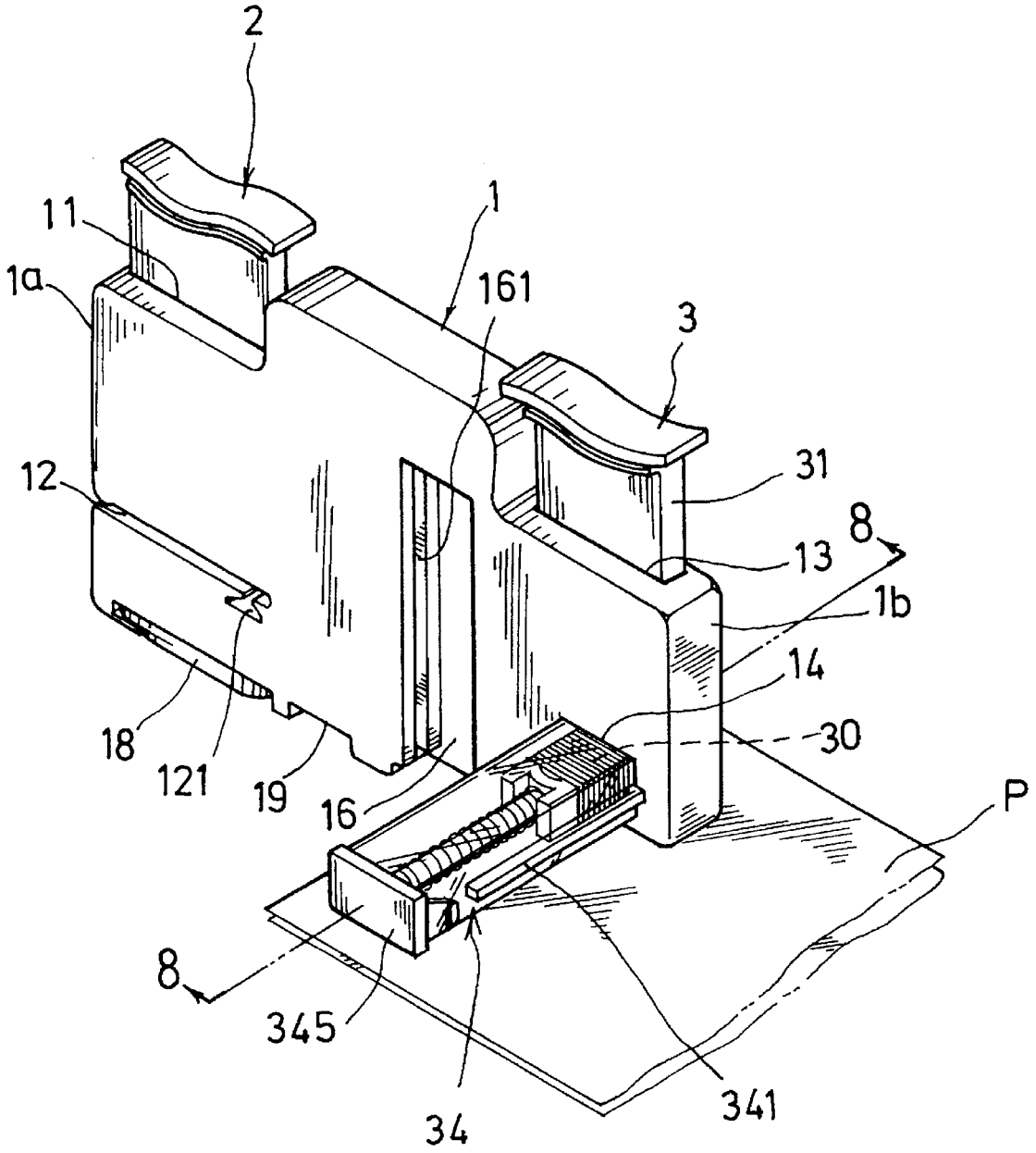
FIG. 6 is a perspective view showing papers being stapled by the stapling device.
Figure 7:
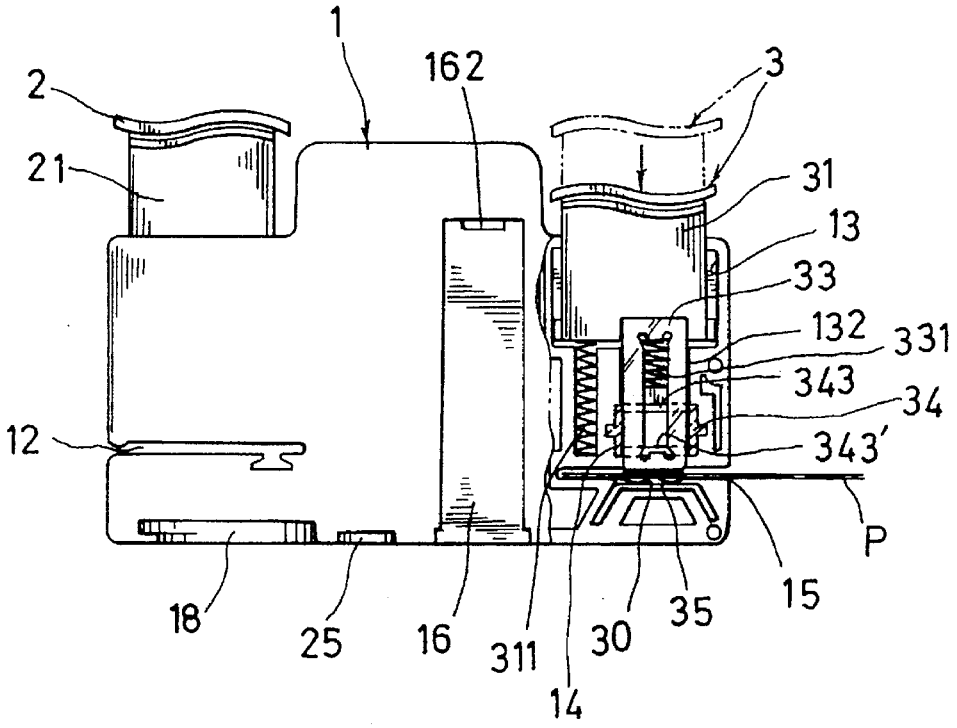
FIG. 7 is a side partially sectional view showing the depression portion of the stapling device depressed for stapling the papers.
Figure 8:
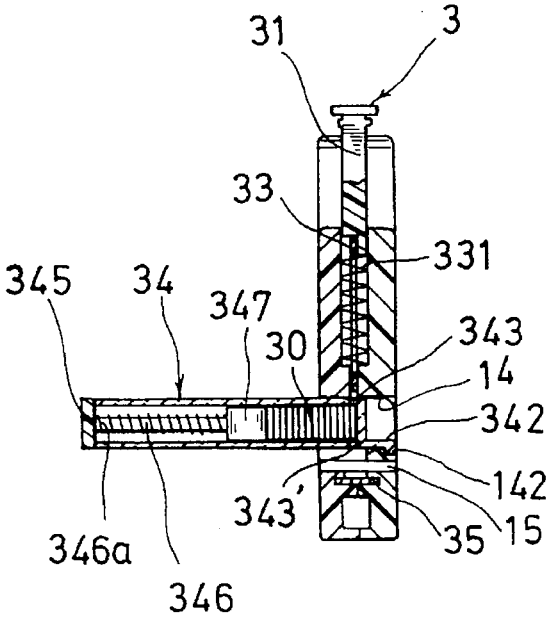
FIG. 8 is a sectional view taken along Line 8—8 of FIG. 6.

With reference to FIGS. 6 to 8, when it is desired to staple the papers, the staple magazine 34 is drawn out from the magazine locating channel 16 and inserted into the magazine socket 14 of the second side 1*b* of the main body 1. At this time, the latch member 342 of the magazine 34 is latched in a latch recess 142 of a front latch bar 141 of the magazine socket 14, whereby the magazine 34 is securely located in the socket 14 with the slits 343 aligned with lower end of the pressing board 33. Accordingly, when the depression portion 31 is pressed downward, the pressing board 33 is moved downward to press out the first staple from the magazine 34 for stapling the papers in the stapling slot 15.

The above minitype perforating device and stapling device are combined into one unit which can be easily carried and freely used to perforate and staple papers.

It is to be understood that the above description and drawings are only used for illustrating one embodiment of the present invention, not intended to limit the scope thereof. Any variation and derivation from the above description and drawings should be included in the scope of the present invention.

What is claimed is:

1. A minitype perforator/stapler comprising:

a main body having opposing substantially planar sides and a first end and a second end, the main body having a perforating slot and a stapling slot formed respectively in the first and second ends of the main body for placing papers therein, the main body having a magazine socket formed above the stapling slot in one of the substantially planar sides, the main body having a magazine locating channel formed in one of the substantially planar sides;

a perforating device having a first depression portion resiliently slidably disposed in a first slide way formed in the first end of the main body, and a perforating knife connected under a lower end of the first depression portion, wherein depressing the first depression portion displaces the perforating knife to perforate papers placed in the perforating slot; and a stapling device having a second depression portion and a staple magazine, the staple magazine having a pair of opposing slits formed in a distal end thereof, the second depression portion being connected to a pressing board and resiliently slidably disposed in a second slide way formed in the second end of the main body, the staple magazine being detachably stored in the magazine locating channel and insertable into the magazine socket with the pair of slits formed in the staple magazine aligned with a lower end of the pressing board, whereby depression of the second depression portion displaces the pressing board to extend into the slits of the staple magazine and displace a staple contained therein for stapling papers placed in the stapling slot.

2. A minitype perforator/stapler as claimed in claim 1, wherein the main body has a receptacle bore formed therein and a cavity formed below the perforating slot, the perforating device further including a hole gauge scale having a stopper plate formed at one end thereof, the gauge scale being slidably received in the receptacle bore of the main body for storage thereof, the gauge scale being removed from the receptacle bore and inserted into the cavity with the stopper plate abutting against one side of the main body for determining a distance between a pair of perforated holes when in use.

3. A minitype perforator/stapler as claimed in claim 1, wherein the staple magazine includes a pair of slide rails disposed on two lateral sides thereof for slidable coupling with two slide channels formed in the magazine locating channel of the main body, the staple magazine including a latch member extending from a distal end of the staple magazine for releasable coupling with a latch hole formed in the magazine locating channel and a latch recess formed in the magazine socket, the staple magazine including a staple pusher including (a) an end board with a pair of lugs extending therefrom for engagement with two latch holes respectively formed in the two lateral sides of the staple magazine, (b) a slide rod upwardly extending from the end board, (c) a spring disposed on the slide rod, and (d) a pushing block slidably disposed on the slide rod at an upper end of the spring for pushing a row of staples to keep a first staple of the row of staples in alignment with the pair of slits of the staple magazine.

* * * * *